US009657509B2

(12) United States Patent
Kopish

(10) Patent No.: US 9,657,509 B2
(45) Date of Patent: May 23, 2017

(54) ARRANGEMENT AND METHOD FOR RETROFITTING GLASS WALL PANEL SYSTEM WITH GLASS WALL PANEL

(71) Applicant: Krueger International, Inc., Green Bay, WI (US)

(72) Inventor: Andrew J. Kopish, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 14/168,542

(22) Filed: Jan. 30, 2014

(65) Prior Publication Data

US 2015/0211286 A1 Jul. 30, 2015

(51) Int. Cl.

| | |
|---|---|
| ***E06B 3/54*** | (2006.01) |
| ***E06B 5/20*** | (2006.01) |
| ***E04B 2/74*** | (2006.01) |
| ***E06B 7/28*** | (2006.01) |
| ***E06B 3/28*** | (2006.01) |

(52) U.S. Cl.

CPC ..... *E06B 3/5418* (2013.01); *E04B 2/7435* (2013.01); *E04B 2/7455* (2013.01); *E06B 3/28* (2013.01); *E06B 5/205* (2013.01); *E06B 7/28* (2013.01)

(58) Field of Classification Search

CPC ..... E04B 2002/7462; E04B 2/7407; E04B 2/7422; E04B 2/7424; E04B 2/7457; E06B 1/36; E06B 3/28; E06B 3/44; E06B 3/5418; E06B 3/62

USPC ..... 52/716.8, 202, 203, 204.69, 204.7, 208, 52/206, 205, 204.6, 786.1, 786.11, 214, 52/204.59, 204.595, 204.597, 204.71

See application file for complete search history.

(56) References Cited

U.S. PATENT DOCUMENTS

| | | | | |
|---|---|---|---|---|
| 1,812,009 | A * | 6/1931 | Lenke | 52/395 |
| 2,191,500 | A * | 2/1940 | Rosling | 52/202 |
| 2,228,358 | A * | 1/1941 | Lowry | 52/204.591 |

(Continued)

OTHER PUBLICATIONS planar definition, Merriam Webster Dictionary (http://www.merriam-webster.com/dictionary/planar), accessed Mar. 30, 2015.*

(Continued)

*Primary Examiner* — James Ference

(74) *Attorney, Agent, or Firm* — Andrus Intellectual Property Law, LLP

(57) ABSTRACT

A wall panel arrangement is designed for use in retrofitting a wall panel system provided with at least one pair of frame members having inwardly facing flat walls for retaining at least one existing glass panel therebetween. The wall panel arrangement includes an add-on glass wall panel and panel mounting structure configured with at least one receiving strip constructed with a planar body having an outer surface secured to one of the inwardly facing flat walls of the frame members in spaced relationship to the existing glass panel. The body also has an inner surface provided at opposite edges thereof with a pair of flexible resilient wall panel retaining elements extending therefrom and converging towards each other to define spaced apart retainer ends which are frictionally engageable with the opposed faces of the glass wall panel adjacent one of the opposed sidewalls thereof.

16 Claims, 5 Drawing Sheets

(56) References Cited

U.S. PATENT DOCUMENTS 2,716,783 A * 9/1955 Fegan ..... 52/202
3,130,455 A * 4/1964 Borlenghi ..... E06B 1/32 49/504
3,214,879 A * 11/1965 Ellingson, Jr. et al. ..... 52/393
3,360,893 A * 1/1968 Wattelez ..... 52/105
3,514,916 A * 6/1970 Hoverman, Jr. ..... E06B 3/62 428/125
3,824,753 A * 7/1974 Anderson ..... E06B 3/64 49/62
3,869,839 A * 3/1975 Johnson et al. ..... 52/204.69
3,971,178 A * 7/1976 Mazzoni ..... E06B 3/5418 52/172
4,074,480 A 2/1978 Burton
4,089,143 A * 5/1978 La Pietra ..... 52/172
4,121,394 A * 10/1978 Brooks ..... 52/203
4,134,240 A * 1/1979 Bologna et al. ..... 52/202
4,160,348 A * 7/1979 Chapman ..... E06B 1/64 160/354
4,320,609 A * 3/1982 Abell ..... 52/202
4,335,166 A * 6/1982 Lizardo et al. ..... 428/34
4,351,137 A * 9/1982 Enyart et al. ..... 52/202
4,363,192 A * 12/1982 Soucy ..... 49/453
4,409,758 A * 10/1983 Dickerson ..... E06B 3/28 160/231.2
4,452,020 A * 6/1984 Werner ..... 52/202
4,459,789 A * 7/1984 Ford ..... 52/656.5
4,463,534 A * 8/1984 Crigler ..... 52/395
4,473,980 A * 10/1984 Foster ..... 52/202
4,478,013 A * 10/1984 Tavano ..... 52/92.2
4,494,342 A * 1/1985 Decker ..... 52/203
4,499,703 A * 2/1985 Rundo ..... 52/746.1
4,503,655 A * 3/1985 Yeager et al. ..... 52/746.1
4,538,390 A * 9/1985 Yeager et al. ..... 174/495
4,561,223 A * 12/1985 Gold et al. ..... 52/202
4,581,865 A * 4/1986 Miller ..... 52/202
4,625,479 A * 12/1986 Giguere ..... 52/202
4,648,221 A * 3/1987 Haggqvist ..... 52/202
4,658,559 A * 4/1987 Doherty ..... 52/463
4,685,261 A * 8/1987 Seaquist ..... 52/202
4,686,805 A * 8/1987 Forslin ..... 52/208
RE32,509 E * 9/1987 Werner ..... 52/202
4,695,499 A * 9/1987 Whitener ..... 428/122
4,848,875 A * 7/1989 Baughman et al. ..... 349/16
4,893,902 A * 1/1990 Baughman et al. ..... 349/16
4,896,473 A * 1/1990 Liebetrau ..... 52/748.11
4,899,503 A * 2/1990 Baughman et al. ..... 52/171.3
5,009,044 A * 4/1991 Baughman et al. ..... 52/171.3
5,058,344 A * 10/1991 Biebuyck ..... 52/235
5,086,604 A * 2/1992 Orth ..... E06B 3/28 52/202
5,111,629 A * 5/1992 Baughman et al. ..... 52/171.3
5,152,111 A * 10/1992 Baughman et al. ..... 52/171.3
5,163,257 A * 11/1992 Crowell ..... 52/200
5,197,242 A * 3/1993 Baughman et al. ..... 52/171.3
5,253,457 A * 10/1993 Orth ..... E06B 3/28 49/62
5,430,981 A * 7/1995 Scott ..... 52/202
5,491,940 A * 2/1996 Bruchu ..... 52/213
5,540,019 A * 7/1996 Beske et al. ..... 52/204.5
5,544,457 A * 8/1996 Labrecque ..... 52/204.69
5,551,205 A * 9/1996 Kidder ..... 52/800.13
5,555,684 A * 9/1996 Galowitz et al. ..... 52/204.5
5,622,017 A * 4/1997 Lynn et al. ..... 52/209
5,649,389 A * 7/1997 Coddens ..... E05D 15/22 49/176
5,713,167 A * 2/1998 Durham et al. ..... 52/204.54
5,806,256 A * 9/1998 Byrne ..... 52/204.5
5,857,298 A * 1/1999 Fullwood ..... 52/202
6,047,508 A * 4/2000 Goodman et al. ..... 52/241
6,088,978 A * 7/2000 Satterwhite ..... 52/200
6,401,410 B2 * 6/2002 Kenny et al. ..... 52/235
6,509,071 B1 * 1/2003 Emek ..... 428/34
6,769,214 B1 * 8/2004 Kenkel et al. ..... 49/436
7,082,736 B2 * 8/2006 Farrar ..... B60J 1/2094 52/202
7,152,906 B1 * 12/2006 Farrar et al. ..... 296/146.15
7,254,927 B1 * 8/2007 Farrar et al. ..... 52/741.3
7,958,682 B2 * 6/2011 Elzein ..... 52/204.53
7,975,442 B1 * 7/2011 Frey ..... 52/204.6
8,272,178 B2 * 9/2012 Pardue et al. ..... 52/202
8,443,570 B2 * 5/2013 Olariu ..... 52/745.16
2002/0108327 A1 * 8/2002 Shaw ..... 52/211
2002/0129575 A1 * 9/2002 Diffrient et al. ..... 52/239
2004/0068943 A1 * 4/2004 Morgan et al. ..... 52/235
2004/0112000 A1 * 6/2004 Kopish ..... 52/656.9
2004/0139681 A1 * 7/2004 Kopish et al. ..... 52/633
2004/0211101 A1 * 10/2004 Pitcher ..... A47G 1/0611 40/658
2006/0286317 A1 * 12/2006 Berkowitz ..... 428/34
2007/0199259 A1 * 8/2007 Parsley ..... 52/203
2009/0049766 A1 * 2/2009 Kopish ..... 52/167.1
2009/0126279 A1 * 5/2009 Kopish ..... 49/409
2009/0139163 A1 * 6/2009 Prete et al. ..... 52/204.593
2009/0139164 A1 * 6/2009 Prete et al. ..... 52/204.593
2009/0139165 A1 * 6/2009 Prete et al. ..... 52/204.593
2009/0241466 A1 * 10/2009 Gussakovsky ..... 52/786.1
2012/0151858 A1 * 6/2012 Friedman ..... 52/309.1
2013/0192141 A1 * 8/2013 Kopish et al. ..... 49/413

OTHER PUBLICATIONS strip definition, Merriam Webster Dictionary (http://www.merriam-webster.com/dictionary/strip), accessed Mar. 30, 2015.*

* cited by examiner

ARRANGEMENT AND METHOD FOR RETROFITTING GLASS WALL PANEL SYSTEM WITH GLASS WALL PANEL

BACKGROUND OF THE INVENTION

The present disclosure relates generally to wall panel systems provided with at least one existing wall panel, such as a glass wall panel, retained therein. More particularly, the present disclosure pertains to an add-on wall panel arrangement used in retrofitting a wall panel system such as may be useful for converting a single pane glass wall panel system into a double or triple pane glass wall panel system in the field.

A wall panel system, such as for use in creating workspaces in an office environment, typically has a frame assembly constructed of a series of spaced apart vertical frame members Connected together by horizontal frame members that extend between adjacent vertical frame members. The vertical and horizontal frame members are configured to define open areas closed by dedicated or existing wall panels retained between the frame members.

Many of today's wall panel systems are constructed with existing wall panels formed of a clear transparent material, such as glass, which will create a certain amount of openness in the walls of the workspace, such as for providing light transmission and visual communication through the glass wall panels. In certain workspace environments employing glass wall panel systems, occupants of the workspaces may be exposed to levels of noise which can negatively affect productivity and psychological comfort. Control of sound between workspaces is desirable not only for worker productivity, but to ensure privacy and safeguard sensitive environments where confidentiality is critical. While glass wall panel systems initially configured with glass or glazed panels offer a certain degree of reduced sound transmission, it is important to be able to upgrade the acoustical properties of a glazed wall panel system on site.

Accordingly, there is a need to provide an add-on wall panel arrangement which can be used to retrofit or convert a previously configured single glazed glass wall panel system to a multiple glazed glass wall panel system that creates a desired level of acoustical privacy in the workspace.

SUMMARY OF THE INVENTION

The present disclosure relates to a wall panel arrangement used in retrofitting a wall panel system provided with at least one pair of frame members having inwardly facing flat walls for retaining at least one existing glass panel therebetween. The wall panel arrangement includes an add-on glass wall panel having opposed faces and opposed sidewalls connected to the opposed faces. A mounting structure is provided on the wall panel system and is configured with at least one receiving strip constructed with a planar body having an outer surface secured to one of the inwardly lacing fiat walls of the frame members in spaced relationship to the existing glass panel, and an inner surface provided at opposite edges thereof with a pair of flexible resilient wall panel retaining elements extending therefrom and converging towards each other to define spaced apart retainer ends which are frictionally engageable with the opposed faces of the glass wall panel adjacent one of the opposed sidewalls thereof.

The mounting structure includes a pair of receiving strips, the body of one of the receiving strips being attached to one of the frame members, and the other of the receiving strips being secured to the other of the frame members. The flexible resilient wall panel retaining elements are both formed as planar fins, each fin lying in a plane oriented at an acute angle relative to a plane of the inner surface of the body. In another embodiment, one of the flexible resilient wall panel retaining elements is formed as a separate glazing bead snap fit into the body, and the other of the flexible resilient wall panel retaining elements is formed as a planar fin, a plane of the portion of the glazing bead and a plane of the tin each being oriented at an acute angle relative to the inner surface of the body.

The present disclosure also relates to a wall panel mounting kit adapted for retrofit use in a wall panel system provided with at least one pair of frame members having inwardly facing flat walls for retaining at least one existing panel therebetween. The mounting kit includes a wall panel having opposed faces and opposed sidewalls connected to the opposed faces. A mounting structure is adapted to be provided on the wall panel system, and is configured with a pair of receiving strips, each being constructed with a planar body adapted to be fixed to one of the inwardly facing flat walls of the frame members. The planar body is provided with flexible resilient wall panel retaining elements which extend outwardly away from the body and converge towards each other to define spaced apart retainer ends frictionally engageable with the opposed faces of the wall panel adjacent the opposed sidewalk thereof.

In one embodiment, the flexible resilient wall panel retaining elements are both formed as planar fins. In another embodiment, one of the flexible resilient wall retaining elements is formed as a separate glazing bead snap fit into a portion of the body, and the other of the flexible retaining elements is formed as a planar fin. The wall panel mounting kit also includes an adhesive strip having one side affixed to an outer surface of the body, and an opposite side adapted to be secured to one of the inwardly facing flat walls of the frame members. The wall panel is preferably constructed of a glass material.

The present disclosure further relates to a wall panel receiving strip adapted to be used in retrofitting a wall panel into a wall panel system provided with at least one pair of frame members having inwardly facing flat walls for retaining at least one existing panel therebetween. The receiving strip includes a planar body having an outer surface adapted to be fixed to one of the inwardly facing flat walls or the frame members, and an inner surface provided at opposite edges thereof with a pair of flexible resilient wall panel retaining elements extending outwardly therefrom and converging towards each other to define spaced apart wall panel retainer ends adapted to be frictionally engageable with opposed faces of the wall panel.

The inner surface is further provided with a projecting member located between the wall panel retaining elements and adapted to provide one of centering the wall panel and securing one of the retaining elements relative to the body. In one embodiment, the projecting member extends generally perpendicularly from a central portion or the inner surface. In another embodiment, the projecting member includes a curled portion adapted to secure one of the wall panel retaining elements relative to the body. In one embodiment, the wall panel retaining elements are both formed of planar fins. In another embodiment, one of the wall panel retaining elements is formed as a separate glazing bead snap fit into the body, and the other of the wall panel retaining elements is formed as a planar fin. The glazing bead includes a first leg having an outer end, and a second leg connected to the first leg and provided with an outer end. The outer end of the first leg is engaged in a snap fit with the curled portion, and the outer end of the second leg is engaged with one of the opposite edges of the body.

The present disclosure additionally contemplates a method of retrofitting a wall panel into a wall panel system provided with at least one pair of frame members having inwardly facing flat walls for retaining at least one existing panel therebetween, the existing panel having opposed external surfaces. The method includes the steps of a) providing a wall panel having opposed faces and opposed sidewalls connected to the opposed faces, and a pair of receiving strips, each of the receiving strips being constructed with a planar body having an outer surface, and an inner surface provided at opposed edges thereof with a pair of flexible resilient wall panel retaining elements extending outwardly therefrom and converging towards each other to define spaced apart retainer ends; b) attaching the outer surface of one of the receiving strips to one of the inwardly facing flat walls of the frame members, and the outer surface of the other of the receiving strips to the other of the inwardly facing flat walls of the frame members such that the receiving strips are spaced equidistantly relative to one of the opposed external surfaces of the existing panel; and c) positioning the wall panel such that the opposed faces of the wall panel are frictionally engaged with the retaining ends of the wall panel retaining elements so that the wall panel is maintained in spaced relationship relative to the existing panel.

The method includes the step of adhesively securing the outer surfaces of the receiving strips to the inwardly facing flat walls of the frame members. The existing panel and the wall panel are preferably constructed of a glass material.

BRIEF DESCRIPTION OF THE DRAWINGS

The drawings illustrate the best mode presently contemplated in carrying out the disclosure. In the drawings.

DETAILED DESCRIPTION

Figure 1:
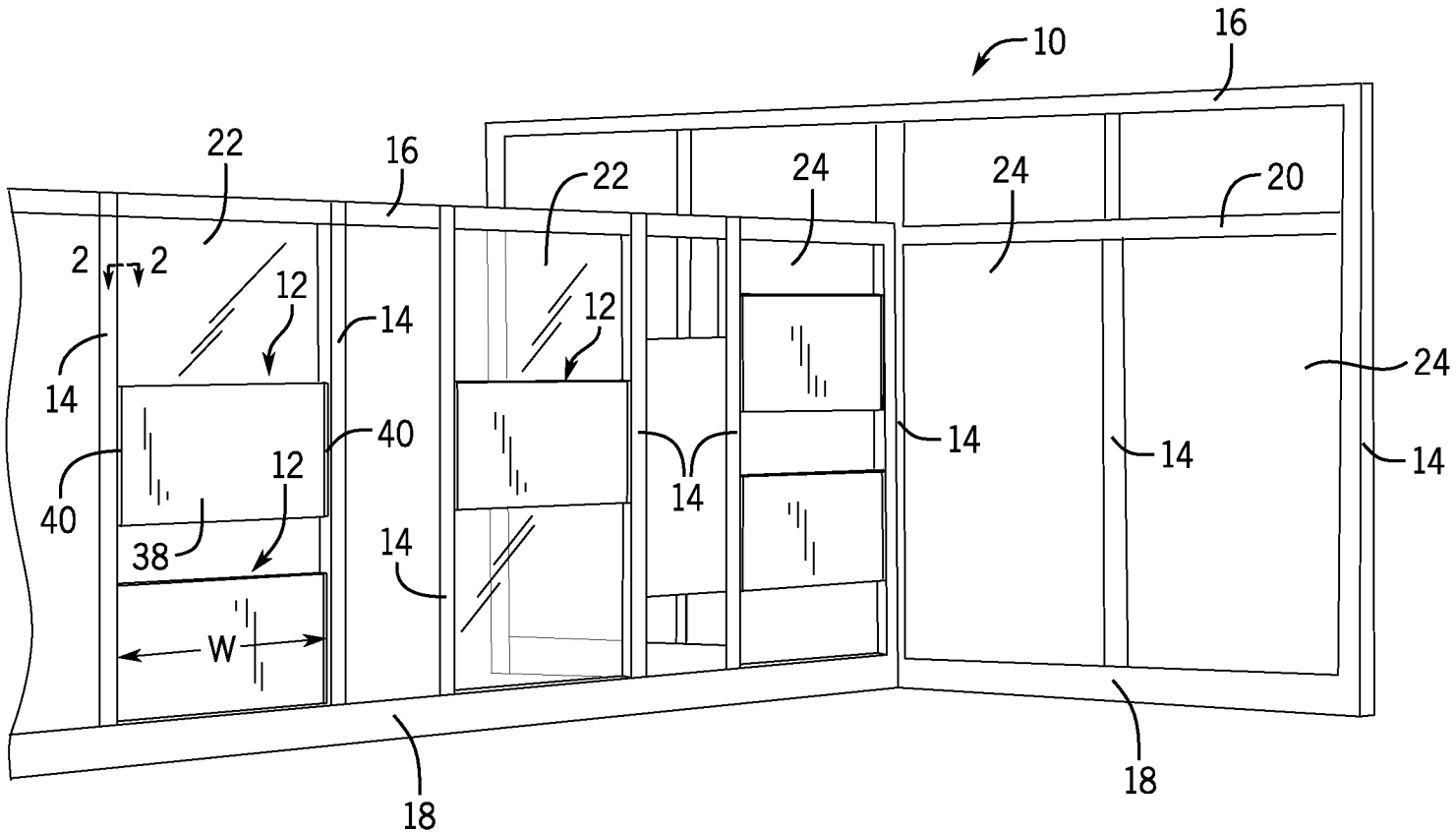
FIG. 1 is a perspective view of an exemplary retrofit installation of multiple glass wall panel arrangements in a wall panel system provided with existing glass panels in accordance with the present disclosure.

Referring now to the drawings, FIG. 1 illustrates a wall panel system 10 which is retrofit with several add-on wall panel arrangements 12, each of which is constructed in accordance with the present disclosure.

The embodiment of FIG. 1 shows the wall panel system 10 which includes to frame assembly configured with a series of spaced apart vertical frame members 14 that are interconnected by a set of upper horizontal frame members 16, lower horizontal frame members 18 and an intermediate horizontal frame member 20. The frame members 14, 16, 18, 20 serve to support and retain a number of dedicated or existing wall panels which preferably include light-transmitting glass panels 22, and may also include non-glass panels 24. Wall panel system 10 is typically movable and is commonly used with a number of similar wall panel systems 10 and related components which can be shipped to an installation site in knocked down form, and then assembled on site according to a predetermined wall configuration. If desired, the wall configuration can be disassembled and reconfigured to provide flexibility in dividing a space and/or creating a workspace.

Referring now to the embodiment variously depicted in FIGS. 2-5, the glass panel 22 of the wall panel system 10 is shown as a solid single pane or glazed glass plate construction having opposed flat external surfaces 26, 28 and opposed side edges, one being shown at 30. The glass panel 22 is held in position by securing each side edge 30 within a recess 32 formed centrally in an inwardly facing flat wall 34 of the vertical frame member 14 using a retaining assembly 36. With this construction, the glass panel 22 is securely maintained between an adjacent pair of spaced apart vertical frame members 14 as seen in FIG. 1. As is well known, the vertical frame members 14 are configured to be connected with other vertical frame members 14 or other wall system components, such as a door frame member.

Figure 2:
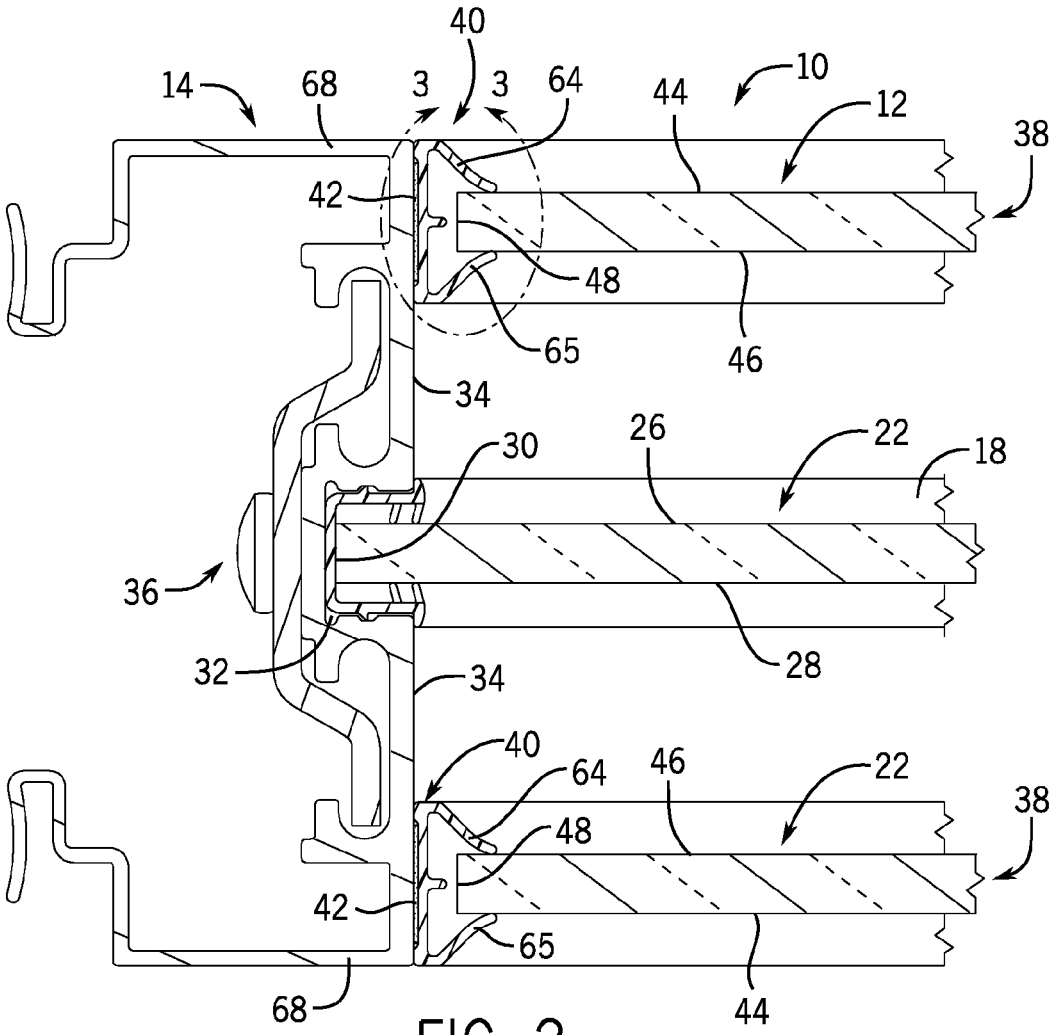
FIG. 2 is an enlarged sectional of one embodiment of the glass wall panel arrangements taken on line 2-2 of FIG. 1.

In accordance with the present disclosure, each wall panel arrangement 12 is designed to provide an add-on wall panel construction, preferably a glass wall panel construction, which can be retrofit on site in the wall panel system 10 by means of a convenient pop-in or snap-in installation. Such wall panel construction is particularly useful in converting a single pane glass wall panel system 10 into a multiple pane glass wall system 10, and providing a desired level of acoustical privacy in the workspace(s) defined by the wall panel system 10. For example, as shown in FIG. 2, one glass panel arrangement 12 is mounted between the vertical frame members 14 in spaced relationship from the external surface 26, and another glass wall panel arrangement 12 is mounted between the vertical frame members 14 in spaced relationship to the other external surface 28 to define a triple pane system for increasing sound control in the wall panel system 10. Double pane and other multiple pane systems are contemplated by the present disclosure.

Each wall panel arrangement 12 is generally comprised of a glass wall and 38, and a mounting structure defined by a pair of identical elongated receiving strips 40. Each receiving strip 40 is secured preferably by means of a double-sided adhesive strip 42 to one of the inwardly facing flat walls 34 of the vertical frame members 14 in spaced relationship to the existing glass panel 22, and is frictionally engaged with the glass wall panel 38.

The glass wall panel 38 is generally rectangular in cross section, and includes opposed horizontally extending faces 44, 46 and opposed side edges connected thereto, one side edge being seen at 48. The glass wall panel 38 has a width w (FIG. 1) designed to be less than the spacing between the inwardly facing flat walls 34 of the vertical frame members 14, and is configured to be received and retained by the receiving strips 40 as will be described below. The glass wall panel 38 can be sized to be retrofit within the wall panel system 10 in spaced relationship to selected portions of the glass panels 22 or the entire surface of the glass panels 22 as desired.

It should be appreciated that the wall panel 38 as well as the panel 22 may be constructed of various types of glass, such as, for example, plain glass, translucent glass, textured glass, stained glass, tempered glass, insulated glass and variously glazed glass.

Figure 3:
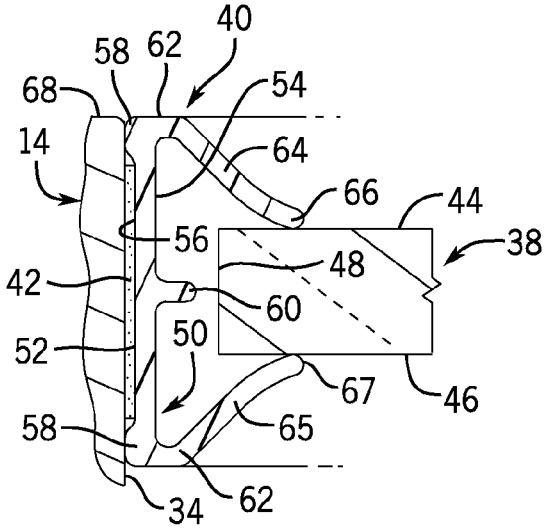
FIG. 3 is an enlarged detail view of a portion of the glass wall panel arrangement taken on line 3-3 of FIG. 2 showing a receiving strip installed on a vertical frame member of the wall panel system and engaged with a glass wall panel.
Figure 4:
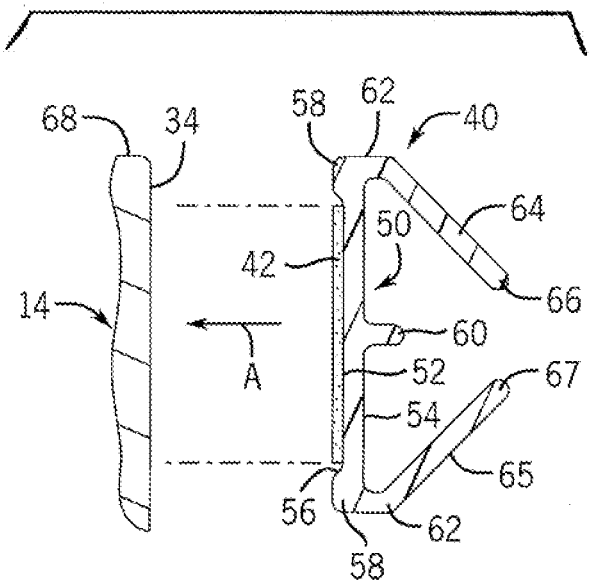
FIG. 4 is a diagrammatic representation of the installation of the receiving strip of FIG. 3 on the vertical frame member.
Figure 5:
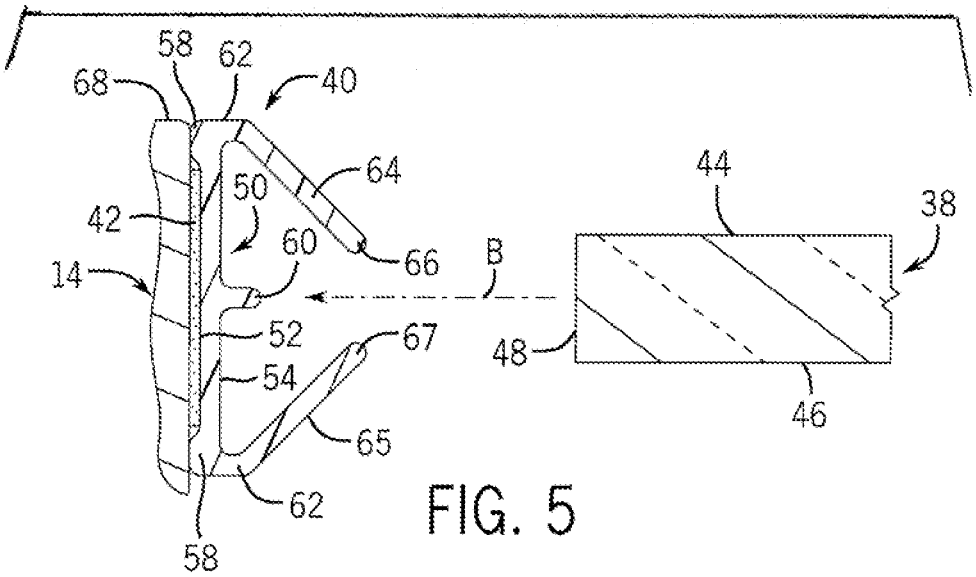
FIG. 5 is a diagrammatic representation of the glass wall panel prior to engagement with the installed receiving strip of FIG. 4.

As best seen in FIGS. 3-5, each receiving strip 40 is constructed of a generally planar body 50 having an outer surface 52 and an inner surface 54 which are typically molded from a rigid material such as polyvinyl chloride (PVC). The outer surface 52 is provided with a recess 56 which is formed between enlarged outer portions 58 and designed to receive and retain the adhesive strip 42. The inner surface 54 is formed with a projecting member 60 which extends generally perpendicularly therefrom in a direction opposite the outer surface 52. The inner surface 54 has opposite edges 62 connected with the outer portions 58 and is integrally formed with a pair of flexible resilient wall retaining elements in the form of planar fins 64, 65 which extend outwardly therefrom and normally converge towards each other as shown in FIGS. 4 and 5. Each fin 64, 65 lies in a plane oriented at an acute angle relative to the plane of the inner surface 54. The fins 64, 65 are typically molded of a polyvinyl chloride (PVC) material which is flexible and resilient in comparison to the rigid body 50. For aesthetic purposes, the tins 64, 65 can be formed of a clear PVC material which does not obstruct the peripheral sight lines of the glass panels 22 and 38. The flexible resilient fins 64, 65 define spaced apart retainer ends 66, 67 which are designed to be frictionally engageable with the opposed faces 44, 46 of the glass panel 38 adjacent each of the opposed side edges 48 thereof.

Each wall panel arrangement 12 can be conveniently provided in the form of a mounting kit comprised of at least one glass wall panel 38, at least one pair of receiving strips 40 and at least one pair of adhesive strips 42. It has been found that a double-sided adhesive tape sold by the 3M Corporation of St. Paul, Minn., under the trademark 3M VHB Tape provides a desired sealing behavior and performs well as the adhesive strip 42. When provided in kit form, one side of the adhesive strip 42 may be adhered to the outer surface 52 of the receiving strip 40 in the area defined by the recess 56, while the other side of the adhesive strip 42 remains protectively covered by as removable tape.

When it is desired to retrofit the wall panel system 10 with the wall panel arrangement 12 to provide a multi-pane or multiple glazed glass system such as shown in FIG. 2, the receiving strips 40 must first be properly mounted on the inwardly facing flat walls 34 of the spaced apart vertical frame members 14. As depicted in FIG. 4, the protective tape is removed from each adhesive strip 42 so that the body 50 of each receiving ship can be moved in the direction of arrow A and secured to the respective inwardly facing flat wall 34 in spaced apart relation to the glass panel 22. Each receiving strip 40 is moved such that the outermost edge 62 is aligned with a respective surface 68 of the vertical frame member 14, and the outer portions 58 abut the flat wall 34.

Once the receiving strips 40 have been fixed in the proper alignment on the flat walls 34 of the vertical frame members 14, the glass panel 38 can be brought into a pop-in engagement with the flexible resilient tins 64, 65 represented by the dotted arrow B in FIG. 5. In practice, each glass panel 38 is advanced or pushed towards glass panel 22 such that fins 64 will first deflect inwardly, and then fins 65 will also deflect inwardly until the face 44 of the glass panel 38 clears the fins 64. At this point, the opposed faces 44, 46 of the glass panel 38 are frictionally engaged by the respective retaining ends 66, 67 of the fins 64, 65 adjacent the side edges 48 of the glass panels 38. FIGS. 2 and 3 show the glass panels 38 installed in spaced relationship relative to each external surface 26, 28 of the glass panel 22. The projecting members 58 serve to provide a centering function for the glass panels 38.

As seen in FIGS. 6-9, the present disclosure, contemplates an alternative embodiment of the wall panel arrangement 12 similar to that shown in FIGS. 2-5 except for modified receiving strips 40'. Each receiving strip 40' is constructed with the planar body 50 integrally formed at one edge 62 with the fin 65 defining one of the flexible resilient retaining elements. The projecting member 60' formed centrally on the inner surface 54 of the body 50 has a curled portion 70 terminating in an end 72. The opposite edge 62 of each receiving, strip 40' is formed with an inwardly bent retaining finger 74. The other flexible resilient retaining element is defined by a separate glazing bead 76 designed to be snap fit into portions of the body 50 and frictionally engaged with the face 44 of the glass panel 38.

More particularly, the glazing bead 76 includes a first horizontally extending leg 78 and a second bent leg 80 which extends at an angle away from the first leg 78. The first leg 78 is provided at an outer end with a bead 82 designed to be frictionally engageable with the end 72 on the curled projecting member 60. The first leg 78 also includes a retaining end 84 which is frictionally engageable with the face 44 of glass panel 38. The second leg 80 is formed at an outer end with a projection 86 which is designed to be movably engaged around an outer surface 88 (FIG. 9) of the finger 74, and then frictionally engaged with an inner surface 90 (FIG. 9) of the finger 74.

Figure 6:
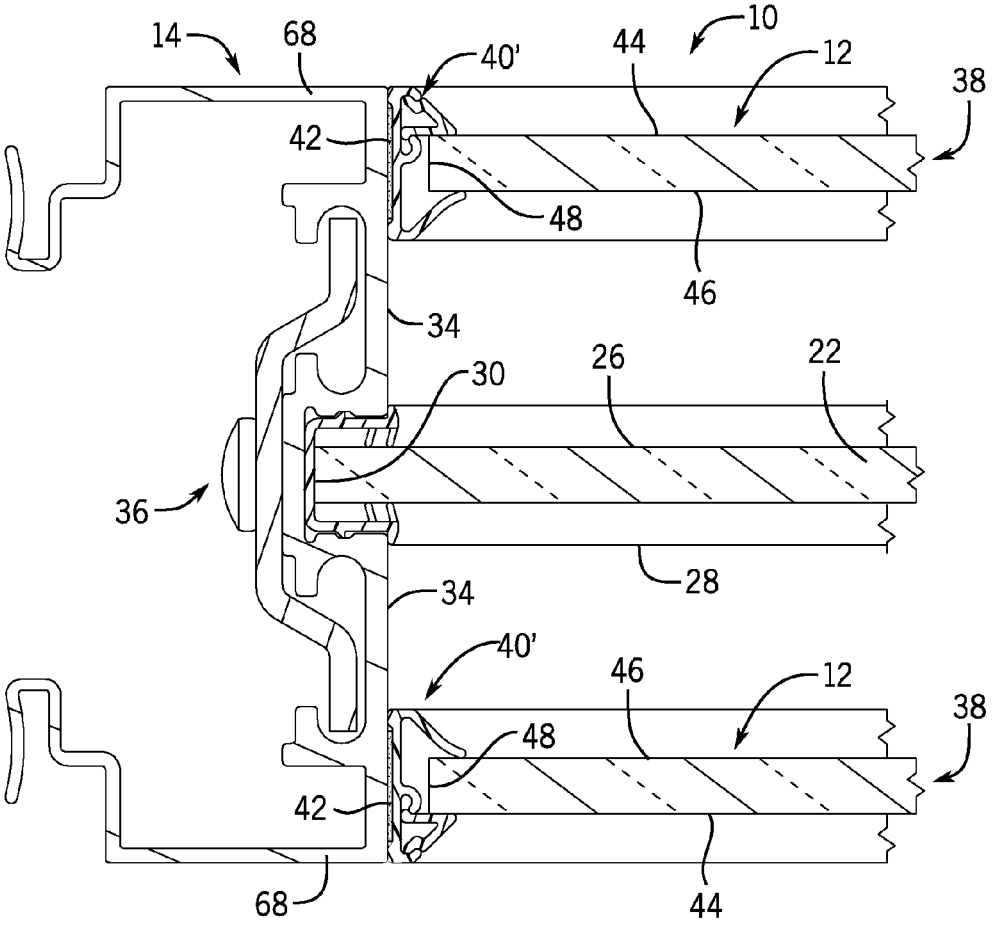
FIG. 6 is an enlarged sectional view of another embodiment of a glass wall panel arrangement.
Figure 7:
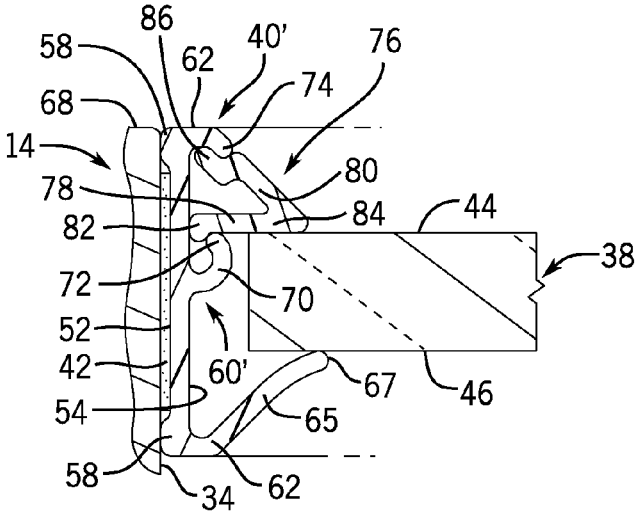
FIG. 7 is an enlarged detail view of a portion of the glass wall panel arrangement of FIG. 6 showing an alternative receiving strip installed on the wall panel system and engaged with a glass wall panel.
Figure 8:
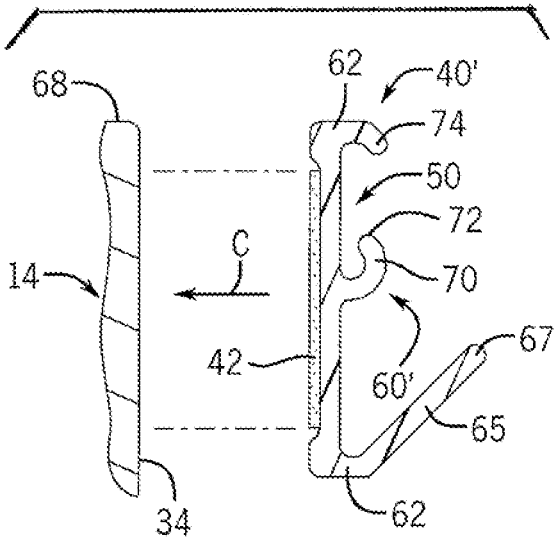
FIG. 8 is a diagrammatic representation of the installation of a portion of the receiving strip of FIG. 7 on the wall panel system.
Figure 9:
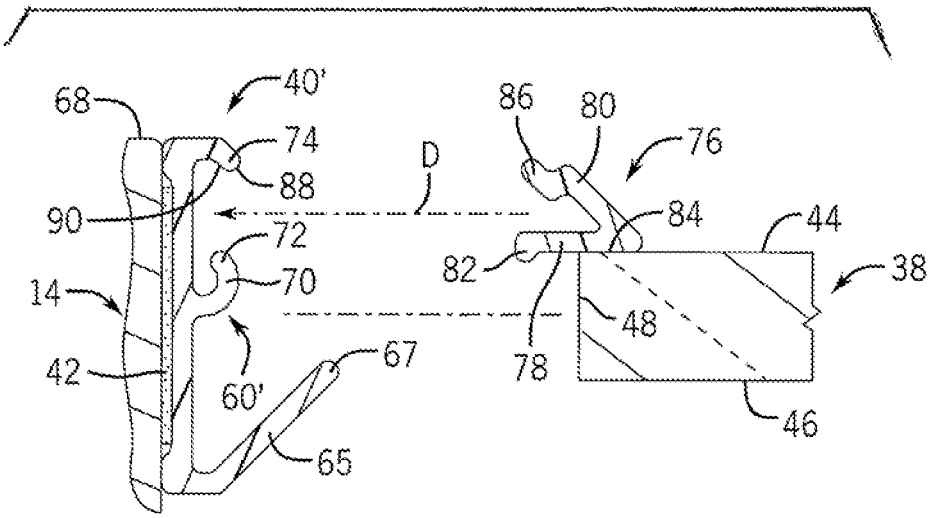
FIG. 9 is a diagrammatic representation of the glass wall panel prior to engagement in the receiving strip of FIG. 8.

When it is desired to provide the multiple pane glass system shown in FIG. 6, the receiving strips 40' are adhesively secured to the flat walls 34 the vertical frame members 14 in a manner as similarly described above. FIG. 8 diagrammatically depicts the joining path of each retaining strip 40' in the direction of arrow C towards the fiat wall 34 of the vertical frame member 14. Once the receiving strips 40' have been fixed in position, the glass panel 38 can be brought into engagement with the retaining elements 65, 76 in the direction of dotted arrow D as generally depicted in FIG. 9. In practice, each glass panel 38 is advanced towards the glass panel 22 so that the face 46 causes deflection of the fin 65 away from the body 50. Then, the projection 86 of each glazing bead 76 is rotated around the outer surface 88 of each finger 74 and into frictional engagement with the inner surface 90. Such motion simultaneously brings the retainer end 84 into engagement with the lace 44 of the glass panel 38. At this point, each bead 82 can then be snapped over the end 72, and brought against the inner surface 54 of each body 50 to provide the wall panel system 10 shown in FIG. 6. In this alternative embodiment, the flexible resilient retaining elements 65, 80 converge towards each other with a plane of the leg 80 and a plane of the fin 63 being oriented at acute angles relative to the inner surface 54 of the body 50.

Although the exemplary embodiments of the wall panel arrangement 12 in the present disclosure as shown using the retaining strips 40, 40' to retrofit glass panels 38, it should he understood that the retaining strips 40, 40' can also be used to mount non-glass panels if desired between spaced apart frame members of a wall panel system 10 constructed of various existing wall panels.

The present disclosure thus provides a pop-in or snap-in glass wall panel arrangement and method used in retrofitting a glass wall panel system to convert a single glazed wall panel system into a multiple glazed wall panel system on site without the use of any tools. The wall panel arrangement disclosed herein can reduce noise transmission in the workspace defined by the wall panel system so as to improve productivity and psychological comfort of the workspace occupant as well as offer a heightened level of privacy. The present disclosure further provides a wall panel mounting kit including unique receiving strips which are easily installed on frame members of the wall panel system for frictionally engaging an add-on wall panel without the need to form holes or recesses in the frame members.

Various alternatives and embodiments are contemplated as being within the scope of the hallowing claims particularly pointing out and distinctly claiming, the subject matter regarded as the invention.

I claim:

1. A wall panel arrangement used in retrofitting a wall panel system provided with an upper horizontal frame member, a lower horizontal frame member and at least one pair of vertical frame members having inwardly facing flat walls for retaining at least one existing glass panel therebetween, the wall panel arrangement comprising:

an add-on glass wall panel having a top edge, a bottom edge, opposed faces and opposed side walls connected to the opposed faces; and a mounting structure provided on the wall panel system, the mounting structure including only a pair of spaced receiving strips each having a planar body having opposite side edges, the planar body having a planar outer surface secured to one of the inwardly facing flat walls of one of the vertical frame members in spaced relationship to the existing glass panel, and a planar inner surface, wherein the planar body includes a pair of flexible resilient wall panel retaining elements each having a first end connected to one of the side edges of the planar body and a second retainer end, wherein the retaining elements are each arranged at an acute angle relative to a plane of the inner surface of the body such that the retaining elements converge towards each other, wherein the second retainer ends frictionally engage opposed faces of the add-on glass wall panel adjacent one of the opposed sidewalls thereof to support the add-on glass wall panel in a desired vertical position between the pair of vertical frame members, wherein the bottom edge is spaced from the lower horizontal frame member such that the lower horizontal frame member does not support the add-on glass wall panel.

2. The wall panel arrangement of claim 1, wherein the flexible resilient wall panel retaining elements are both formed of planar fins, each fin lying in a plane oriented at the acute angle relative to the plane of the inner surface of the body.

3. The wall panel arrangement of claim 1, wherein one of the flexible resilient wall panel retaining elements is formed as a separate glazing bead snap fit into the body, and the other of the flexible resilient wall panel retaining elements is formed as a planar fin, a plane of a portion of the glazing bead and a plane of the fin each being oriented at an acute angle relative to the inner surface of the body.

4. A wall panel mounting kit adapted for retrofit use in a wall panel system provided with an upper horizontal frame member, a lower horizontal frame member and at least one pair of vertical frame members having inwardly facing flat walls for retaining at least one existing wall panel therebetween, the mounting kit comprising:

an add-on wall panel having opposed faces and opposed sidewalls connected to the opposed faces; and a mounting structure adapted to be provided on the wall panel system and configured with a pair of receiving strips each having a planar body having opposite side edges, the planar body including a planar outer surface adapted to be fixed to one of the inwardly facing flat walls of the vertical frame members and provided with flexible resilient wall panel retaining elements each having a first end connected to one of the side edges of the planar body and a second retainer end, wherein the retaining elements are each arranged at an acute angle relative to a plane of the inner surface of the body such that the retaining elements converge towards each other, wherein the second retainer ends frictionally engage the opposed faces of the add-on wall panel to support the add-on glass wall panel in a desired vertical position between the pair of vertical frame members such that the sidewalls of the add-on wall panel are located adjacent the inwardly facing flat walls of the vertical frame members, wherein the bottom edge is spaced from the lower horizontal frame member such that the lower horizontal frame member does not support the add-on glass wall panel.

5. The wall panel mounting kit of claim 4, wherein the flexible resilient wall panel retaining elements are both formed as planar fins.

6. The wall panel mounting kit of claim 4, wherein one of the flexible resilient wall panel retaining elements is formed as a separate glazing bead snap fit into a portion of the body, and the other of the flexible wall panel retaining elements is formed as a planar fin.

7. The wall panel mounting kit of claim 4, including an adhesive strip having one side affixed to an outer surface of the body, and an opposite side adapted to be secured to one of the inwardly facing flat walls of the vertical frame members.

8. The wall panel mounting kit of claim 4, wherein the add-on wall panel is constructed of a glass material.

9. A wall panel receiving strip adapted to be used in retrofitting an add-on wall panel into a wall panel system provided with an upper horizontal frame member, a lower horizontal frame member and at least one pair of vertical frame members having inwardly facing flat walls for retaining at least one existing panel therebetween, the receiving strip comprising:

a planar body having opposite side edges, a planar outer surface adapted to be fixed to one of the inwardly facing flat walls of the vertical frame members, and a planar inner surface, the planar body including a pair of flexible resilient wall panel retaining elements each having a first end connected to one of the opposite side edges of the planar body and a second retainer end, wherein the retaining elements are each arranged at an acute angle relative to a plane of the inner surface of the body such that the retaining elements converge towards each other, wherein the second ends frictionally engage opposed faces of the add-on wall panel to support the add-on glass wall panel in a desired vertical position between the pair of vertical frame members, wherein the bottom edge is spaced from the lower horizontal frame member such that the lower horizontal frame member does not support the add-on glass wall panel.

10. The wall panel receiving strip of claim 9, wherein the inner surface is further provided with a projecting member located between the wall panel retaining elements and adapted to provide one of centering the wall panel and securing one of the retaining elements relative to the body.

11. The wall panel receiving strip of claim 10, wherein the projecting member extends generally perpendicularly from a central portion of the inner surface.

12. The wall panel receiving strip of claim 10, wherein the projecting member includes a curled portion adapted to secure one of the wall panel retaining elements relative to the body.

13. The wall panel receiving strip of claim 12, wherein one of the wall panel retaining elements is formed as a separate glazing bead snap fit into the body and the other of the wall panel retaining elements is formed as a planar fin.

14. The wall panel receiving strip of claim 13, wherein the glazing bead includes a first leg having an outer end, and a second leg connected to the first leg and provided with an outer end.

15. The wall panel receiving strip of claim 14, wherein the outer end of the first leg is engaged in a snap fit with the curled portion, and the outer end of the second leg is engaged with one of the opposed edges of the body.

16. The wall panel receiving strip of claim 9, wherein the wall panel retaining elements are both formed of planar fins.

* * * * *